United States Patent [19]

Batts et al.

[11] Patent Number: 4,945,458

[45] Date of Patent: Jul. 31, 1990

[54] FIREMAN'S HELMET WITH INTEGRAL FRONT AND REAR LIGHTS

[76] Inventors: Felix M. Batts, 804 Ward Blvd., Wilson Woods, Apt. 1; Joseph W. Walker, 504 Briggs St., both of Wilson, N.C. 27893

[21] Appl. No.: 314,163

[22] Filed: Feb. 23, 1989

Related U.S. Application Data

[63] Continuation-in-part of Ser. No. 156,410, Feb. 16, 1988, abandoned.

[51] Int. Cl.[5] ..... F21L 15/14

[52] U.S. Cl. ..... 362/106; 362/207; 2/5; 2/209.2

[58] Field of Search ..... 362/105, 106, 184, 164, 362/234, 295, 205, 207, 183; 315/360, 361; 340/825.69, 825.72, 825.19, 825.47, 825.48; 2/5, 205, 209.2

[56] References Cited

U.S. PATENT DOCUMENTS

| | | | |
|---|---|---|---|
| 1,206,356 | 11/1916 | Norton | 362/106 |
| 1,749,998 | 3/1930 | Collins | 2/5 |
| 2,286,685 | 6/1942 | Moxley | 362/207 |
| 2,473,394 | 6/1949 | Scott | 362/106 |
| 3,749,902 | 7/1973 | Drew | 362/106 |
| 4,225,906 | 9/1980 | Gulliksen et al. | 362/106 |
| 4,263,588 | 4/1981 | Gautier | 362/106 |
| 4,495,495 | 1/1985 | Ormanns et al. | 340/825.69 |
| 4,530,112 | 7/1985 | Cecala et al. | 362/105 |
| 4,559,586 | 12/1985 | Slarve | 362/106 |
| 4,703,402 | 10/1987 | Hsieh | 362/205 |

FOREIGN PATENT DOCUMENTS

| | | | |
|---|---|---|---|
| 589123 | 12/1959 | Canada | 2/5 |

*Primary Examiner*—Stephen F. Husar
*Assistant Examiner*—Richard R. Cole
*Attorney, Agent, or Firm*—Rhodes, Coats & Bennett

[57] ABSTRACT

The present invention entails a fireman's helmet which includes a surrounding wall structure that defines a head receiving area therein. Formed within the surrounding wall structure is an integral front and rear light assembly. A battery pack is mounted internally within the head receiving area. A switch panel is also secured to the helmet and operatively interconnected between the battery pack and the front and rear light assemblies for controlling the same.

18 Claims, 8 Drawing Sheets

FIREMAN'S HELMET WITH INTEGRAL FRONT AND REAR LIGHTS

REFERENCE TO RELATED APPLICATION

This is a continuation-in-part of U.S. patent application Ser. No. 156,410, filed Feb. 16, 1988 now abandoned.

FIELD OF THE INVENTION

The present invention related to helmets and head protective gear, and more particularly to a fireman's helmet provided with integrally formed front and rear light assemblies.

BACKGROUND OF THE INVENTION

Firefighting is a dangerous profession. Each day hundreds of firefighters are placed in life-threatening positions as they attempt to save lives and property.

It is not uncommon for a fireman to find him or herself in a smoked filled building with surrounding high temperature and visibility practically nonexistent. In other words, the fireman cannot see as far as two feet.

Visibility has always been a serious problem for fireman and very little has been done about the problem. There have been some attempts at attaching a light to the fireman's helmet. However, attaching a light to a fireman's helmet often creates more problems than it solves. It is virtually impossible to keep an attached light on a fireman's helmet as the fireman crawls and bangs himself around in a dark, smoke filled room while fighting a fire.

SUMMARY AND OBJECTS OF THE INVENTION

The present invention entails a fireman's helmet that is provided with front and rear light assemblies that are integrally constructed within the helmet structure and which can be remotely controlled. In particular, the light assembly includes a front light capable of projecting a highly intense light beam a substantial distance from the helmet. The rear light assembly in the present disclosure, comprises a red reflective lense, but does, in fact, include a powered light bulb for emitting light.

It is, therefore, an object of the present invention to provide a fireman's helmet that is extremely safe and which helps in overcoming many of the disadvantages associated with conventional fireman's helmets.

It is also an object of the present invention to provide a fireman's helmet with integral light bulb assemblies that are actually built into the helmet and which do not project or extend outwardly from the helmet in an obtrusive manner.

A further object of the present invention resides in the provision of a fireman's helmet that has an integral constructed front light bulb assembly and an integrally constructed rear light bulb assembly wherein both light bulb assemblies can be either remotely controlled or controlled by a panel of switches disposed within the helmet itself.

Another object of the present invention resides in the provision of a fireman's helmet of the character referred to above that is specifically designed such that the light bulb assemblies extend inwardly into the head receiving area of the helmet thereby effectively recessing the lights in the helmet structure to form a neat and clean design.

Another object of the present invention resides in the provision of a fireman's helmet of the character referred to above that is of a relatively simple design and which can be manufactured economically.

It is, therefore, an object of the present invention to provide a fireman's helmet that incorporates a communications or signaling system.

Other objects and advantages of the present invention will become apparent and obvious from a study of the following description and the accompanying drawings which are merely illustrative of such invention.

DETAILED DESCRIPTION OF THE INVENTION

Figure 1:
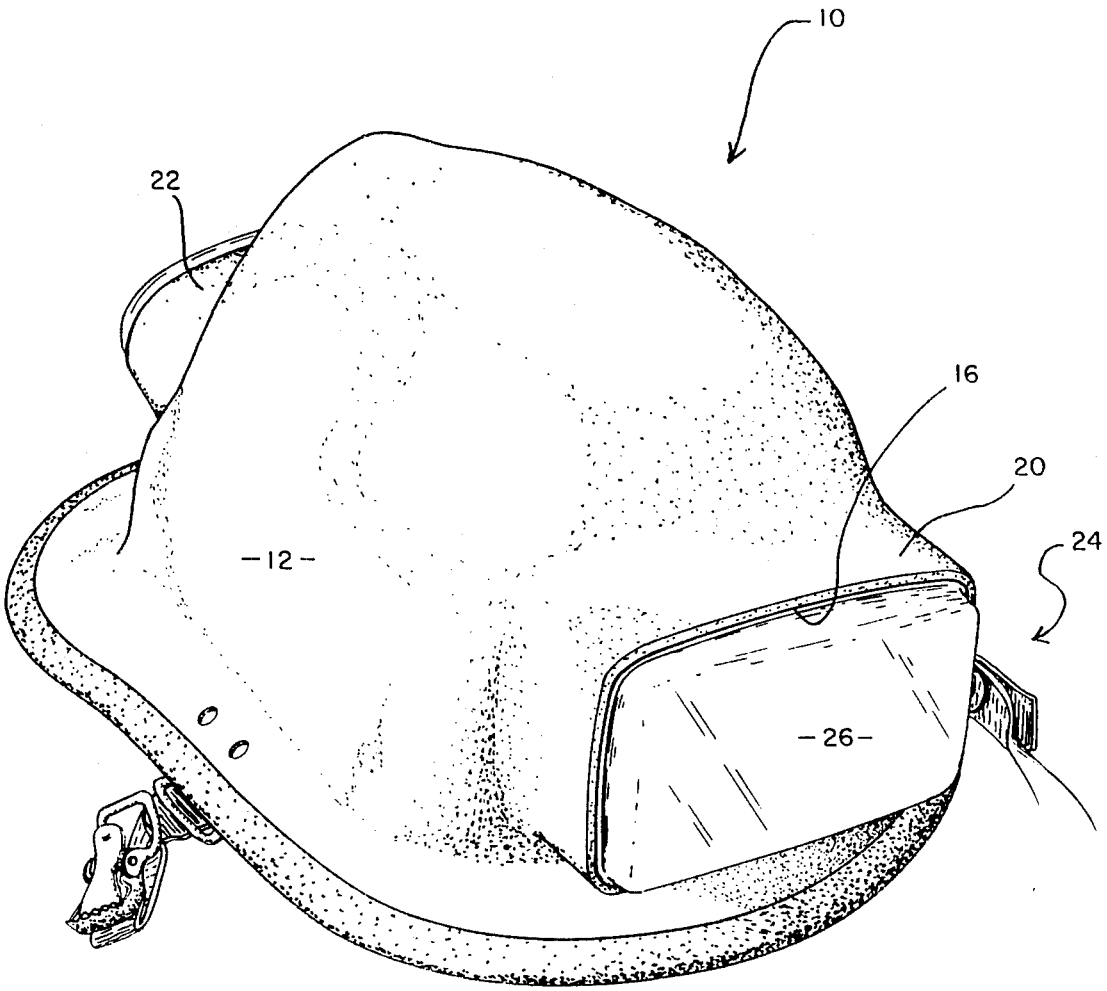
FIG. 1 is a perspective view of the fireman's helmet of the present invention.
Figure 2:
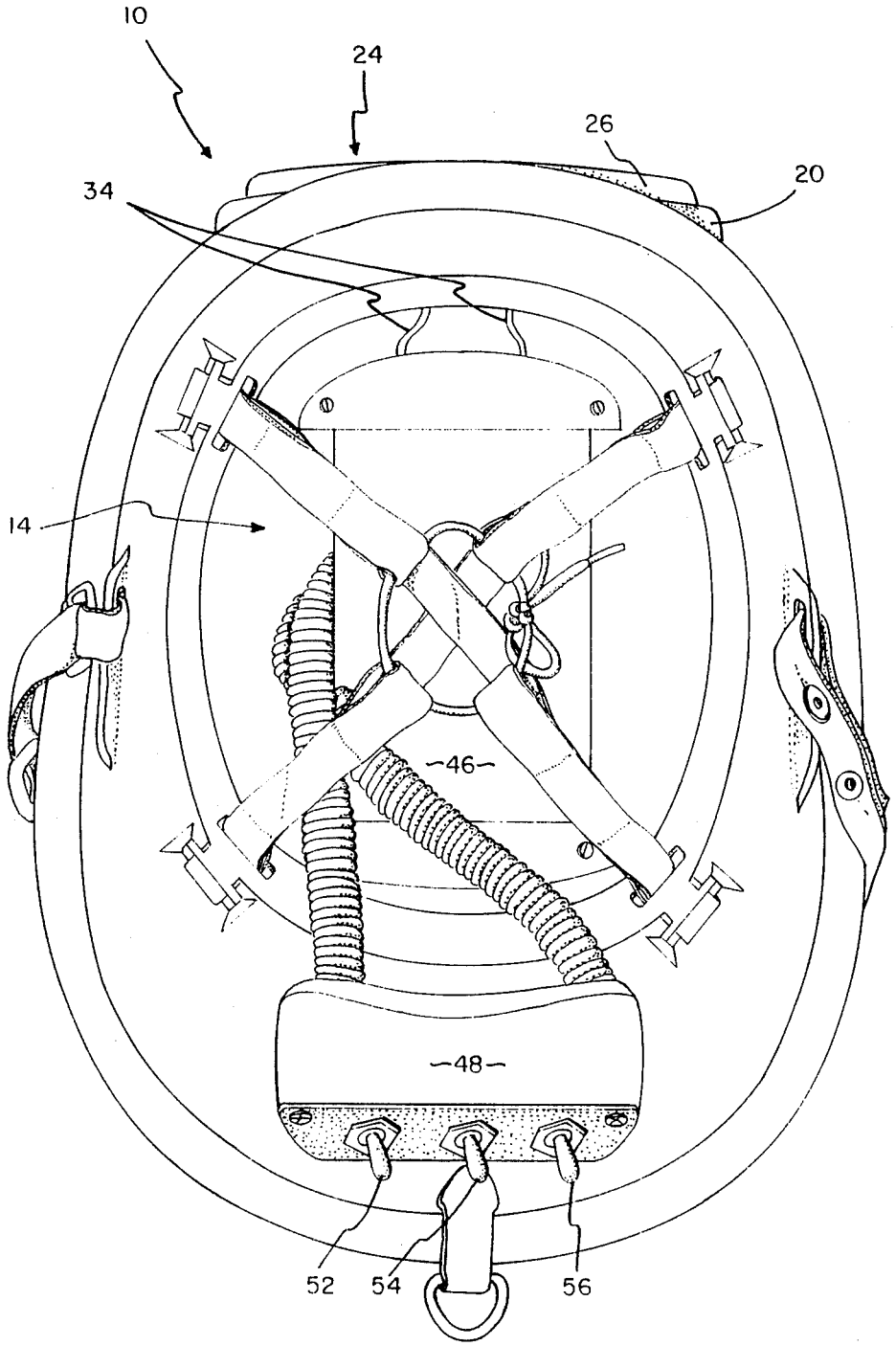
FIG. 2 is a bottom plan view of the fireman's helmet of the present invention.
Figure 3:
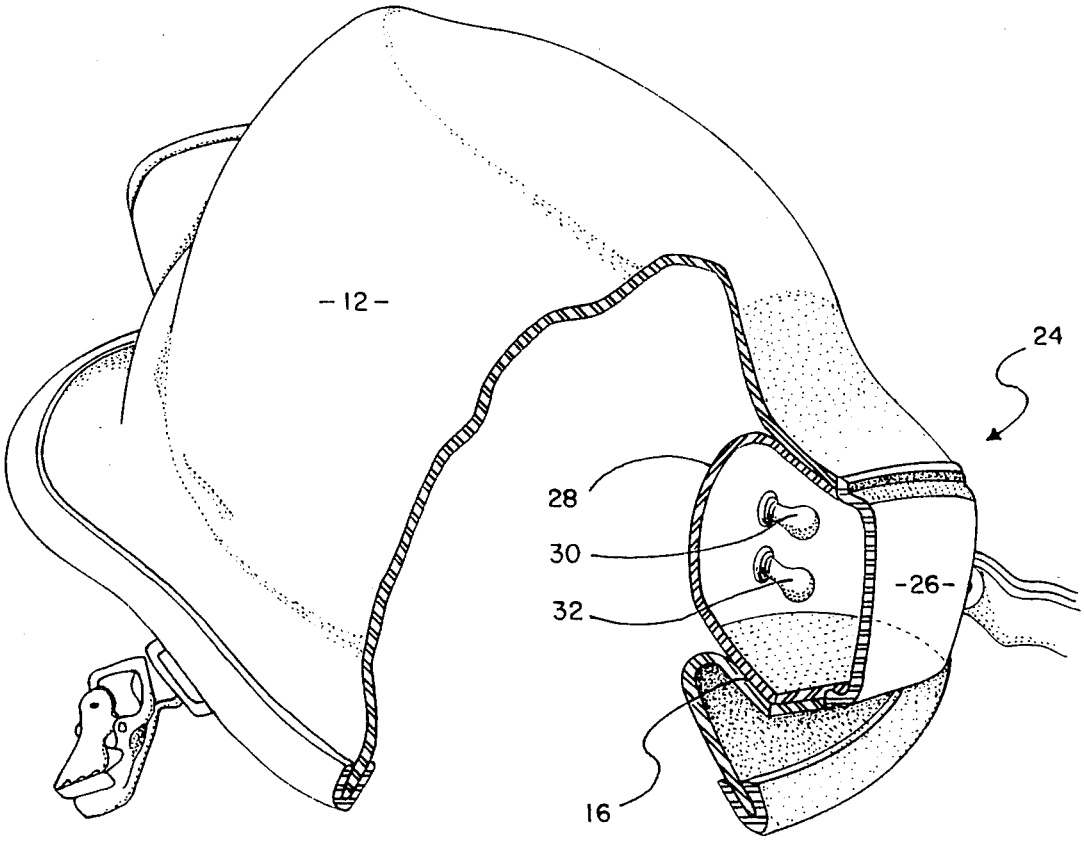
FIG. 3 is a perspective fragmentary view illustrating the integral construction of the fireman's helmet and front light bulb assembly.
Figure 4:
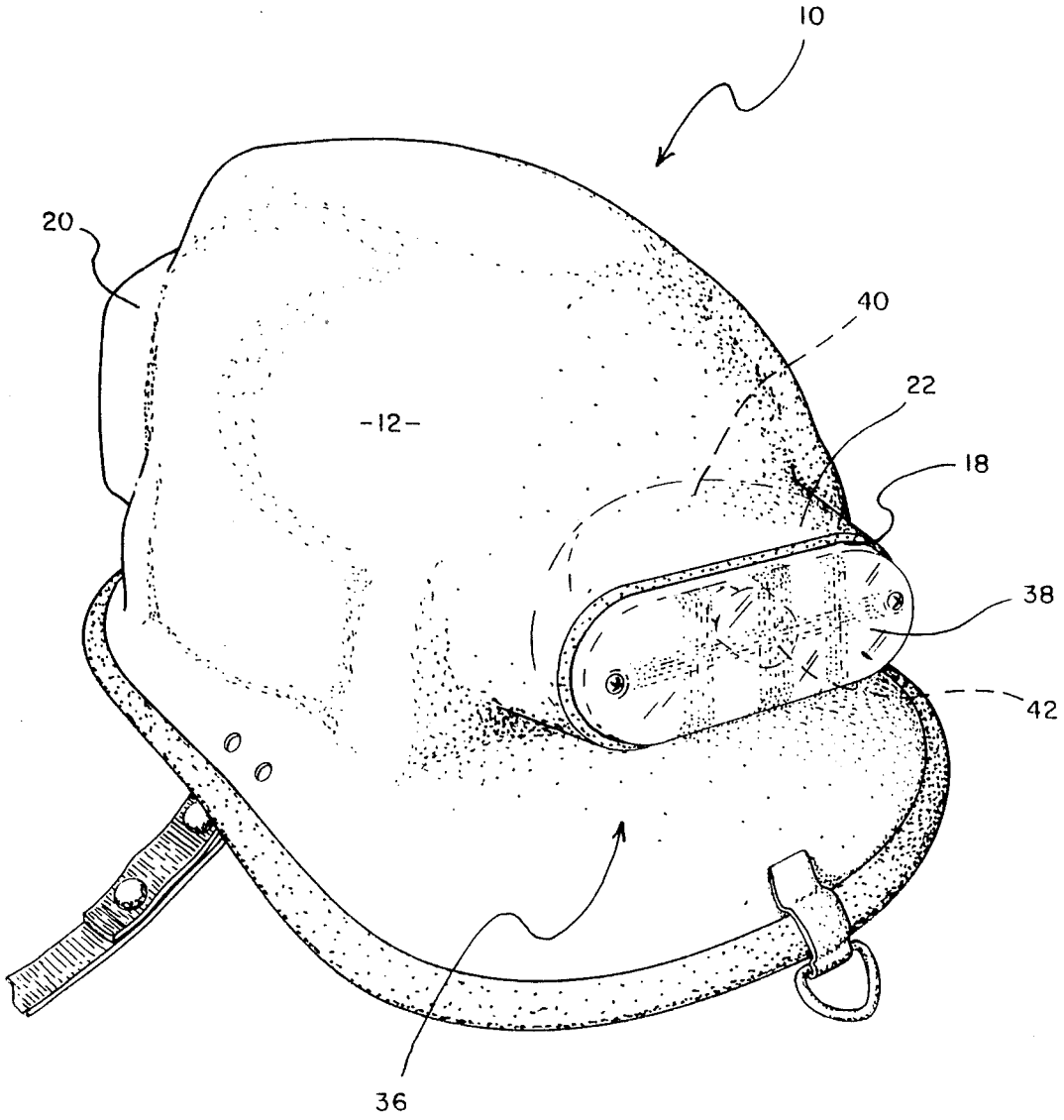
FIG. 4 is a perspective view of the fireman's helmet illustrating the rear light bulb assembly.
Figure 5:
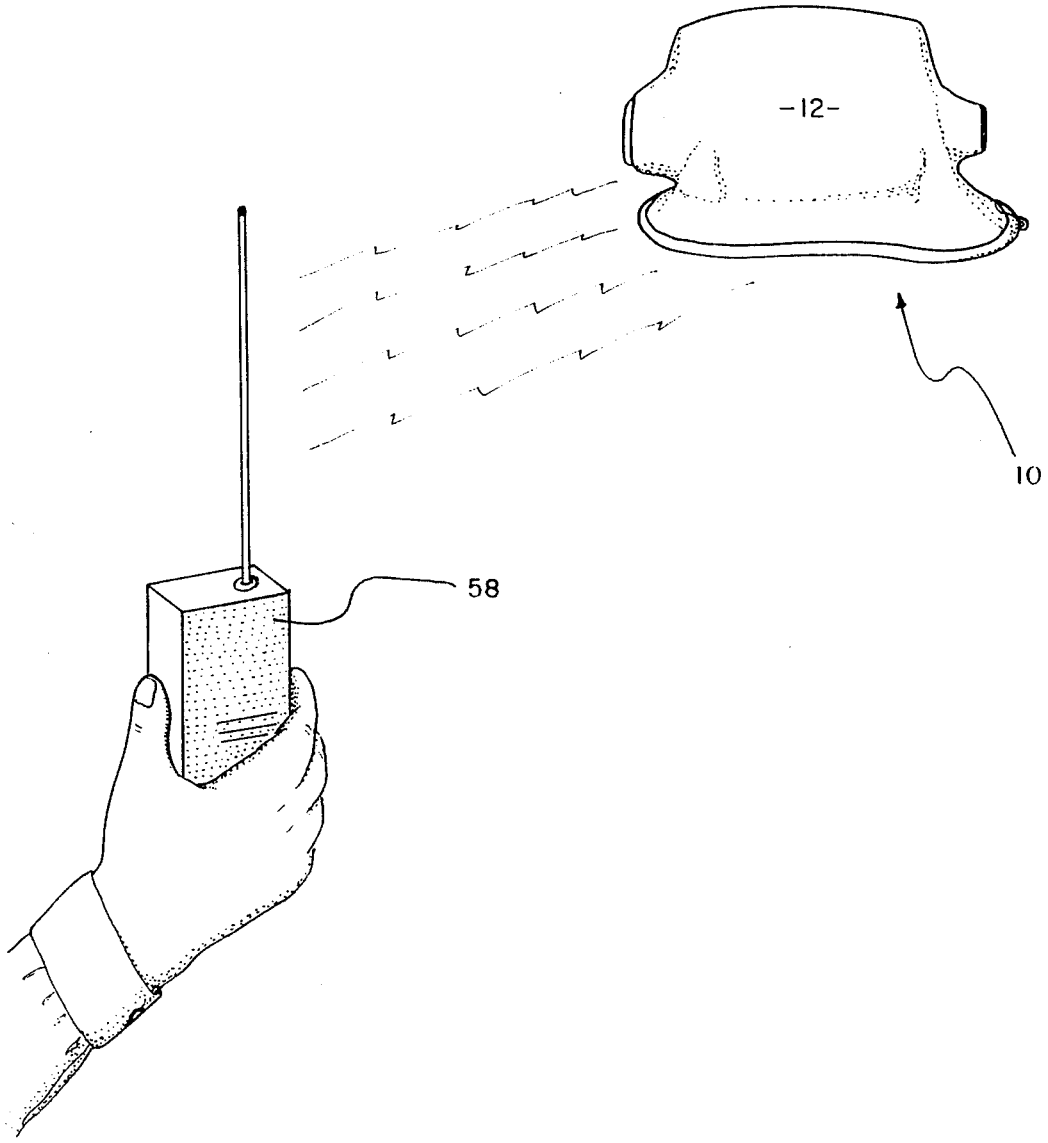
FIG. 5 is a schematic drawing illustrating the remote control for the front and rear light bulb assemblies of the fireman's helmet.

With further reference to the drawings, the fireman's helmet of the present invention is shown therein and indicated generally by the numeral 10.

Viewing helmet in detail, it is seen that the same includes a surrounding wall structure 12 that defines a head receiving area 14 therein.

Surrounding wall structure 12 includes front and rear areas. Formed in the front area is a front opening 16. Formed in the rear area is a rear opening 18. As seen in the drawings, there is provided a front flange 20 that extends outwardly around the circumference of the front opening 16. Likewise, a rear flange 22 extends outwardly around the circumference of rear opening 18.

A front light assembly 24 is integrally formed within side wall structure 12 about the front area thereof and particularly about front opening 16. As seen in the drawings, front light assembly 24 includes a lense 26 and a housing structure 28. Secured within the housing structure 28 is double light bulbs 30 and 32. Note that housing 28 projects inwardly into the head receiving area 14 such that the entire front light assembly assumes a generally recessed position within the housing. Note also, that lense 26, which is a transparent lense, generally lies closely adjacent the surrounding wall structure 12 as opposed to being disposed outwardly thereof. Connecting wires 34 connect to the double light bulbs 30 and 32 and extend from the light bulb assembly housing 28.

Integrally constructed about the rear portion of the surrounding side wall structure 12 is a rear light bulb assembly 36. Rear light bulb assembly 36 comprises a lense plate 38 which in the case of the present disclosure assumes a red reflector type lense. Also, forming a part of the rear light bulb assembly 36 is housing 40 that includes and supports a light bulb 42. A set of wires 44 are connected to light bulb 42 and extend away from rear light bulb assembly 36 through the head receiving area 14.

Although various light bulbs may be used in both front and rear head assemblies, the present disclosure contemplates the use of a 55 watt, halogen light bulb.

To power the front and rear light bulb assemblies 24 and 36 respectively, the present invention provides a battery pack 46 mounted about the top portion of the head receiving area 14. In the present case, the battery pack is a 9.6 volt DC battery rated at 1,250 milliamps. Preferably, battery pack 46 is of the quick charge type.

To control front and rear light bulb assemblies 24 an 36, there is provided a switch panel that is operatively interconnected between the respective light bulb assemblies 24 and 36 and the battery pack 46. In addition, as particularly illustrated in FIG. 6, there is provided a flasher 50 that is operatively interconnected between switch panel 48 and the front light assembly 24. Switch panel 48 includes a series of three switches 52, 54, 56 that control the front and rear light bulb assemblies 24 and 36. As seen in the schematic, the front and rear light bulb assemblies 24 and 36 can be actuated to assume the "on" position at the same time or they each can be operated independently.

Figure 6:
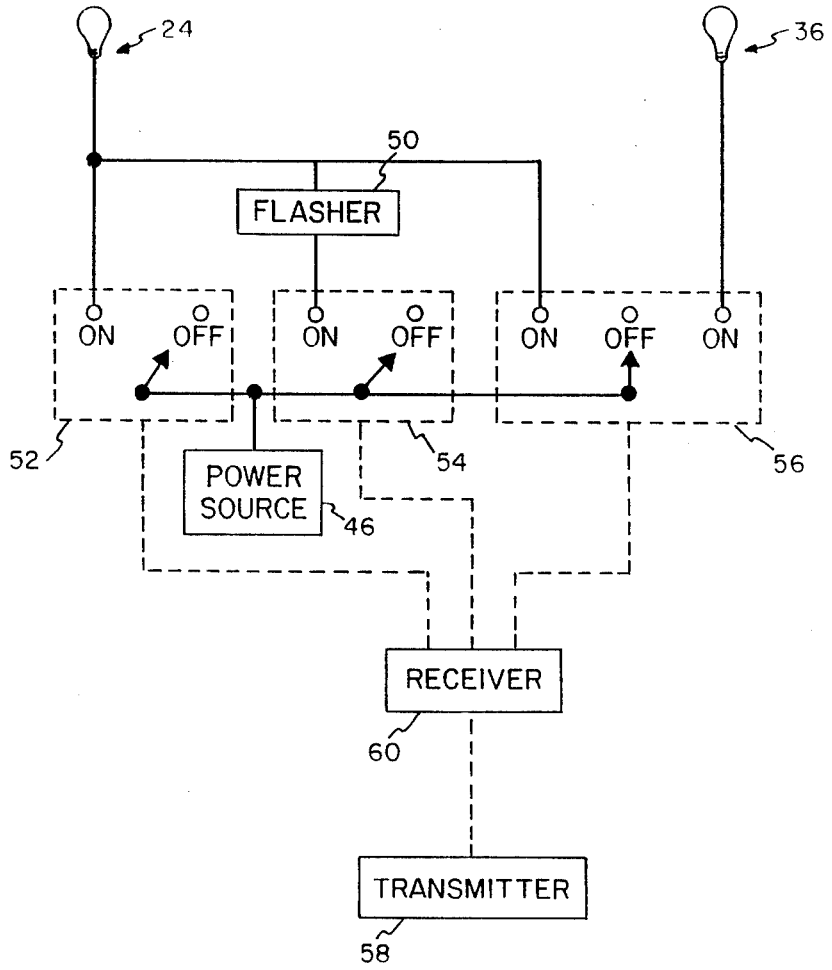
FIG. 6 is a schematic illustration of the switching control system for the front and rear light bulb assemblies.

With reference to the schematic illustration, FIG. 6, it is seen that switch 52 simply actuates front light 24. Switch 54 actuates front light 24 through a flasher 50. It is appreciated that in order for the flasher to be effective that switch 52 must be in the off position. Switch 56 is a three position switch. In one position, switch 56 is operative to actuate front light 24. In a second position, switch 56 is operative to actuate back light 36. Finally, switch 56 includes a third position which is the "off" position.

There is a need to remotely control the light bulbs of the respective light bulb assemblies 24 and 36. In particular, it is desirable for the fire chief or some other individual associated with the fire department to have the capability of remotely actuating and controlling these front and rear light assemblies. Therefore, the present invention provides an actuating and control transmitter 58 that is designed to actuate a receiver 60 which is operatively connected in the circuit illustrated in FIG. 6. Therefore, it is appreciated that an individual stationed outside a burning structure can cause the lights on a fireman's helmet who is inside a burning building to be turned on. This obviously would aid in locating a fireman in trouble.

As illustrated in the schematic, FIG. 6, it is seen that the control circuit includes a flasher 50. The utilization of flasher 50 gives the helmet 10 communications capability, especially when considered in conjunction with the transmitter 58 and receiver 60. For example, if the fire chief or other individual in a position of control, sees that one or more firemen are in imminent danger, then that individual through the transmitter 58 and receiver 60 can actuate the flasher 50 causing the front light 24 to flash on a helmet being worn by firemen. It can be predetermined that this is a signal of danger and a command or adivsory to the particular fireman involved to move away from the point of imminent danger. Thus, it is appreciated that the fireman's helmet 10 of the present invention incorporates communication and signaling capabilities.

Figure 10:
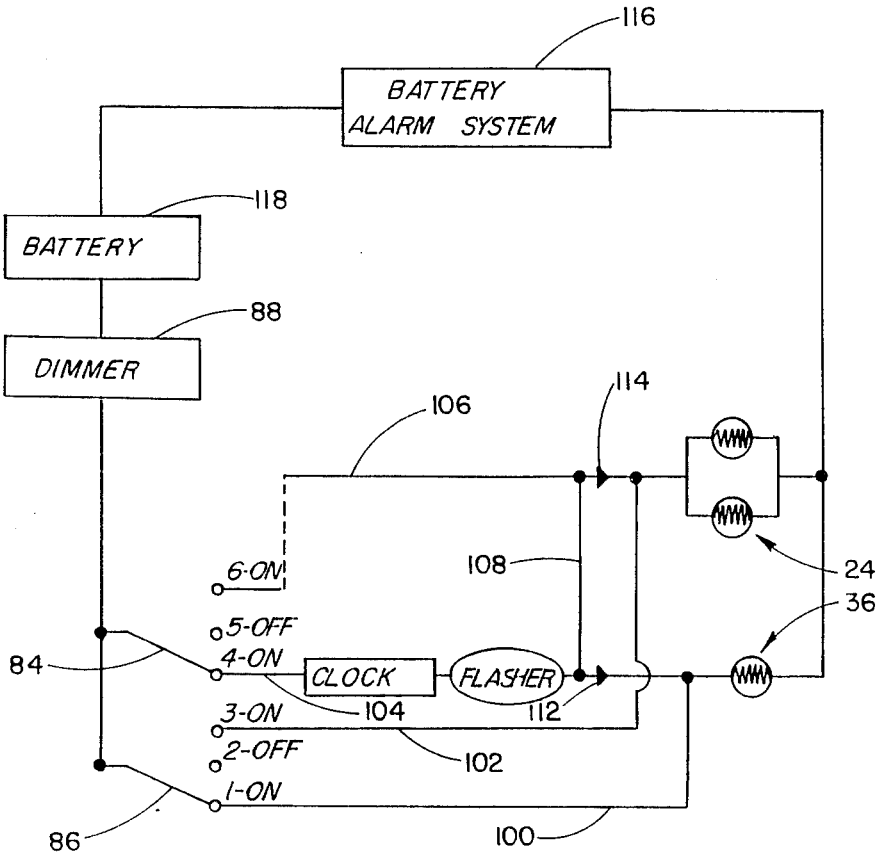
FIG. 10 is an electrical schematic illustration for the alternate design.

Now turning to FIG. 10, an alternate design for the helmet 10 is shown. This alternate design includes a number of design features that do not form a part of the disclosure discussed herein before. However, it should be appreciated that the basic structure of the alternate design to be hereafter described is essentially the same as that for the helmet disclosed in FIGS. 1–6.

Figure 7:
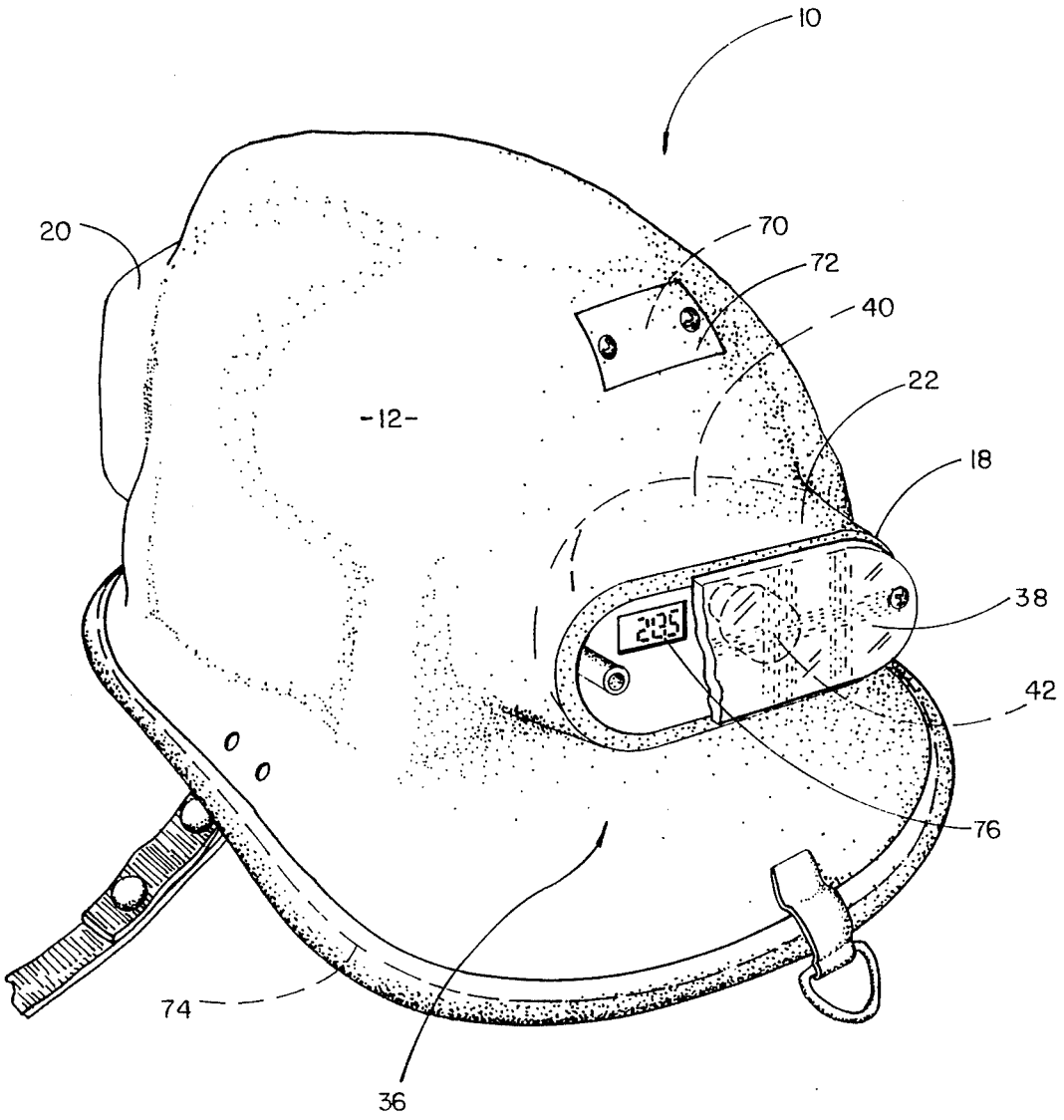
FIG. 7 is perspective view of an alternate design for the helmet of the present invention.

Referring to the alternate design shown in FIG. 7, it is seen that the helmet 10 includes a battery compartment 70 formed in the top portion of helmet 10. Access is gained to battery compartment 70 through an access panel 72 secured within an opening formed about the surface of the helmet 10. It is appreciated that access opening 72 enables the user to have direct access to the battery compartment 70. This enables the batteries to be quickly and easily changed.

As illustrated in FIG. 10, operatively connected to the battery for powering the front and rear lights is a battery alarm device 116 that indicates to the user that the effective battery power has been reduced to a certain level. For example, the battery alarm device would be adapted to emit a signal, preferably an audible signal, once the affective battery power has reached a selected level. It is contemplated that the user of the helmet of the present invention should be warned at least fifteen minutes prior to the battery reaching a power level that would be inadequate for safety purposes.

Also in addition, helmet 10 of the present invention is provided with a clock, preferably a digital readout clock, that is mounted behind rear lens 38. As seen in FIG. 7, the clock is referred to by reference numeral 76. Clock 76 is preferably interconnected within the electrical circuit of the front and rear lightbulb assemblies. In particular, the purpose of the clock is for safety. The clock would be designed to be actuated once the fireman has actuated either or both of the helmet's light assemblies in a flashing mode. For example, clock 76 could be electrically connected in the circuit such that it was actuated when the fireman actuates his rear light or when the rear light is placed in a flashing mode. Therefore, if the fireman gets in trouble and if for any reason becomes disabled, and is rescued, those making the rescue can remove the rear lens 38 and determine for what period of time the fireman has been in a state of emergency or trouble, etc. In that regard, it is appreciated that it could be a policy that once a fireman during the course of fighting a fire encounters a serious or emergency situation where his or her safety could be in danger, at that time the fireman would be instructed to actuate the front and rear light in a flashing mode. At that time, the clock 76 would begin operation. As already stated, if a rescue is required then those individuals making the rescue and any subsequent arriving medical team would know the approximate time that the fireman has been subjected to the problem. It should be noted that clock 76 would have a reset mechanism that would enable the same to be automatically turned back to a time "0" situation.

Also in FIG. 7, it is seen that about the outer periphery of the helmet rim is provided an antenna 74. Antenna 74 is embedded within the surrounding rim of the helmet 10. Antenna 74 forms a part of the communications system previously described. Details of the antenna are not dealt with here in detail because antenna designs are well-known and the particular structure of the antenna is not per se material to the present invention. The important point is the provision of the antenna with the fireman's helmet 10 and its placement and location within the helmet structure itself. The antenna would simply comprise a relatively small flexible wire that is embedded within the rubber brim structure surrounding the helmet.

Figure 8:
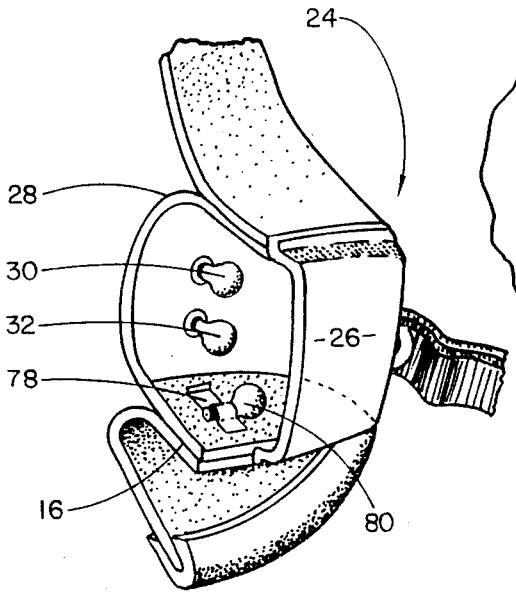
FIG. 8 is a fragmentary perspective view of an alternate design for the helmet of the present invention illustrating a lightbulb storage clip feature.

Turning to FIG. 8, it is seen that the fireman's helmet 10 of the present invention is provided with an auxiliary lightbulb clip 76 that is designed to hold and support two spare lightbulbs 80. Lightbulb clip 78 is illustrated as being mounted within the front lightbulb assembly and is generally disposed behind the front lens 26. It is appreciated that one or more lightbulb clips 78 could be provided.

Figure 9:
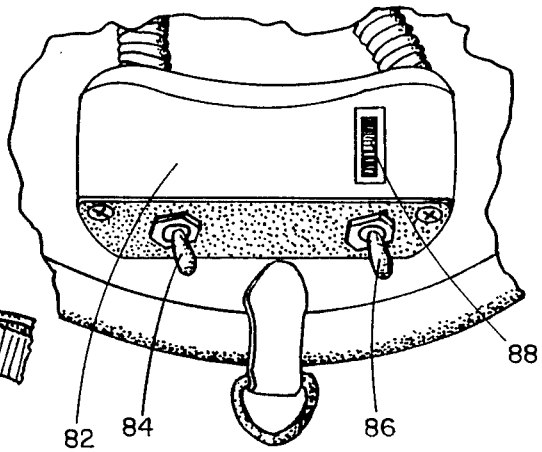
FIG. 9 is a fragmentary perspective view of a control block or control panel for an alternate design.

Turning to FIG. 9, there is illustrated an alternate control panel for controlling the front and rear light assemblies of the alternate design. It will be noted that in this alternate design that the control block referred to by numeral 82 only includes two switches, switch 84 and switch 86. Also, note that the dimmer control 88 is now housed within the control block 82.

With respect to the schematics shown in FIG. 10, it is seen that the same is provided with two main control switches 84 and 86. Each switch is designed to move through three positions. Switch 86 is shown to include three positions, positions 1, 2 and 3. Similarly, switch 84 is shown to include positions 4, 5 and 6.

Extending from switch 86 are lines 100 102 that connect with rear light 36 and front light 24, respectively. Extending from switch 84 are lines 104 and 106 and there is provided a cross connecting line 108 that extends between the two lines 104 and 106. Connected in line 104 is a timer or stop watch type clock 76 and a flasher 110. In addition, connected in lines 104 and 106 is a pair of diodes 112 and 114. Completing the circuit is a conventional battery alarm device 116 and a battery 118. Details of battery alarm device 116 are not dealt with herein in detail because such devices are commercially available and in this case the battery alarm device is not itself per se material to the present invention. But in any event, the function of battery alarm device 116 is to sound or signal an alarm once the potential or power of battery 118 has been reduced to a selected level. It is contemplated that the battery alarm device 116 would be selected such that an alarm signal would be sounded at a point in time when there was no more than approximately fifteen minutes of available power remaining.

In operation of the schematics shown in FIG. 10, first assume that switch 84 is in the "off" or number 5 position. With switch 86 switched to the number 1 "on" position then only rear light 36 would be actuated and it would be actuated continuously. By switching switch 86 to the number 3 "on" position then the front light or lights 24 would be actuated and they would burn continuous.

Now switching switch 84 to the number 4 "on" position with switch 86 being in the "off" or number 2 position would result in both front and rear lights 24 and 26 being flashed. At the same time, clock 76 would be actuated and would start counting time.

With switch 84 in the number 4 "on" position and switch 86 in the number 1 position, rear light 36 would burn continuously while front light 24 would flash. By switching switch 86 to the number 3 "on" position and maintaining switch 84 in the number 4 "on" position, front light 24 would burn continuously while rear light 36 would flash.

It is appreciated that at any time either light flashes that clock or stop watch 76 would be actuated and consequently the same could be utilized by a fireman who experiences trouble or danger. In the event a fireman does experience such danger or a life threatening situation he may actuate either light to a flashing mode at which time the clock or stop watch 76 would start to count. Thus, if the fireman becomes disabled and is rescued, those reaching the fireman will be able to determine the approximate length of time that the fireman has been exposed to such a dangerous situation or environment. It is appreciated that the clock 76 would be of the type that would automatically reset once the flasher circuit or the circuits serving the clock 76 is turned off.

From the foregoing specification and discussion, it is appreciated that the fireman's helmet 10 of the present invention entails a very significant step forward in providing additional safety to fireman while they are either fighting a fire or standing adjacent traffic areas directing traffic in and around a fire area. Of particular importance is the integral construction of the front and rear light assemblies 24 and 36 respectively. Such can be conveniently molded into a plastic or fiberglass helmet such that the light assemblies do not extend outwardly in an unsafe and obtrusive manner. The use of the fireman's helmet 10 of the present invention completely frees the fireman's hands in order that the fireman can most efficiently deal with the problem of rescuing people and getting the fire under control.

The present invention, may of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A helmet including an integral light assembly comprising: a helmet including a surrounding wall structure having an opening formed therein and defining a head receiving area within the helmet; an opening formed wining the surrounding wall structure of the helmet; a light assembly integrally mounted within the opening formed within the side wall structure; said light assembly including an outer lense disposed within a plane that lies closely adjacent the outer surface of the surrounding wall structure, a light bulb, and a light bulb holding frame extending inwardly from the opening within the side wall structure such that it projects into the space of the head receiving area; a battery pack disposed within the head receiving area of the helmet; switch means mounted to said helmet and operatively interconnected between the light bulb assembly and the battery pack for actuating the same; and including a clock integrally formed within the structure of the fireman's helmet whereby by actuating the clock at a selected time enables one to determine an elapsed time from the time of actuation thereby enabling one to determine how long a fireman has been exposed to a dangerous situation.

2. The helmet of claim 1 including operatively connected to the light bulb; and means for remotely controlling and actuating the flasher and light bulb such that the helmet can be utilized as a signaling device in that the light bulb and flasher can be remotely actuated such that the light bulb emits a flashing signal.

3. The helmet of claim 1 wherein the surrounding wall structure includes an access opening panel formed in the exterior of the surrounding wall structure for enabling one to gain access to the battery pack.

4. The helmet of claim 1 wherein the wall structure of the helmet includes a surrounding brim structure and wherein an antenna is implanted within the surrounding brim structure of the helmet.

5. The helmet of claim 1 including lightbulb clip means secured to the helmet structure for receiving and holding spare lightbulbs.

6. The helmet of claim 1 including a control circuit for actuating the clock and wherein the control circuit includes a flasher in the clock and wherein the clock is automatically actuated in response to the actuation of the flasher.

7. The helmet of claim 6 wherein the control circuit includes a battery powered alarm device for sensing the power of a battery provided in the control circuit and actuating a signal in response to the power of the battery being reduced to a certain level.

8. The helmet of claim 1 wherein the light assembly includes front and rear lights and wherein there is provided a control circuit for controlling the front and rear lights; and wherein said switch means comprises a pair of control switches, each switch being a three position switch and adapted to cooperate to control the front and rear lights such that they can be operated in a flashing or continuous mode.

9. The helmet of claim 8 wherein the control circuit includes a flasher and a clock and wherein the clock is placed in the control circuit such that it is automatically actuated in response to the flasher being actuated.

10. A helmet having integrally constructed and remotely controlled front and rear light assemblies, comprising: a helmet structure having a surrounding wall structure having front and rear side areas and a head receiving area formed within the helmet; front and rear openings formed in the surrounding wall structure of the helmet; front and rear light assemblies integrally formed within the front and rear openings within the helmet, each light assembly including a lense, a bulb, and a bulb holding frame structure, and wherein the lense lies generally adjacent the surrounding wall structure while the bulb holding frame projects inwardly from the surrounding side wall structure and occupies a space within the head receiving area; a battery pack disposed within the head receiving area; a switching system mounted within the head receiving area and interconnected between the front and rear light assemblies and the battery pack; a flasher operatively interconnected between the battery pack and of one light assembly; means for remotely actuating and controlling the front and rear light assemblies and the flasher; and including a clock integrally formed within the structure of the fireman's helmet whereby by actuating the clock at a selected time enables one to determine an elapsed time from the time of actuation thereby enabling one to determine how long a fireman has been exposed to a dangerous situation.

11. A fireman's helmet comprising: helmet having a surrounding upper wall structure with front and rear portions and defining an inner head receiving area; front and rear light assemblies integrally molded in the front and rear portions of the upper wall structure of the helmet, each light assembly including an outer lense, a light bulb, and a recessed light bulb holding frame that extends inwardly into the head receiving area of the helmet such that the lense of both light assemblies generally lie adjacent the surface of the upper wall structure and form a part of the helmet's shape; a battery pack mounted in the upper portion of the head receiving area; a switch panel mounted to the helmet and interconnected between the battery pack and the front and rear light assemblies for actuating controlling the front and rear light assemblies, and wherein the switch panel includes switch means for actuating the front and rear light together or independently: and including a clock integrally formed within the structure of the fireman's helmet whereby by actuating the clock at a selected time enables one to determine an elapsed time from the time of actuation thereby enabling one to determine how long a fireman has been exposed to a dangerous situation.

12. The fireman's helmet of claim 11 provided with a transmitter for remotely controlling and actuating the front and rear light assemblies.

13. The fireman's helmet of claim 11 wherein said switch panel is mounted about the rear of the helmet in a lower portion of the head receiving area adjacent the surrounding wall structure of the helmet.

14. The fireman's helmet of claim 11 wherein the rear light assembly includes a red reflector type lense.

15. The fireman's helmet of claim 11 wherein said front light assembly includes a pair of light bulbs.

16. The fireman's helmet of claim 11 wherein the upper wall structure of the helmet includes front and rear openings for receiving the front and rear light assemblies and wherein each opening includes a surrounding flange portion that extends outwardly from the surrounding wall structure and wherein each lense of the respective front and rear light assemblies is fitted and secured within the surrounding flange portion of the respective openings.

17. The fireman's helmet of claim 11 including a flasher operatively connected to one of the light bulb assemblies for selectively flashing that light bulb assembly.

18. The fireman's helmet of claim 17 further including a transmitter and a receiver for remotely controlling the light bulb assemblies and the flasher such that the respective light bulb assemblies can be remotely controlled and wherein an individual stationed remotely from the fireman's helmet can remotely actuate the flasher and cause a light bulb assembly to begin flashing.

* * * * *